US006739910B1

(12) United States Patent
Wu

(10) Patent No.: US 6,739,910 B1
(45) Date of Patent: May 25, 2004

(54) CABLE ASSEMBLY WITH INTERNAL CIRCUIT MODULES

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/617,574

(22) Filed: Jul. 11, 2003

(51) Int. Cl.[7] ..... H01R 13/648
(52) U.S. Cl. ..... 439/608; 439/497
(58) Field of Search ..... 439/608, 497, 439/493, 579

(56) References Cited

U.S. PATENT DOCUMENTS 5,055,069 A * 10/1991 Townsend et al. ..... 439/608
5,429,520 A * 7/1995 Morlion et al. ..... 439/108
5,591,035 A * 1/1997 Burkholder et al. ..... 439/79
5,924,899 A 7/1999 Paagman
6,102,747 A 8/2000 Paagman
6,217,364 B1 4/2001 Miskin et al.

* cited by examiner

*Primary Examiner*—Neil Abrams
*Assistant Examiner*—Phuong Dinh
(74) *Attorney, Agent, or Firm*—Wei Te Chung

(57) ABSTRACT

A cable assembly (1) includes an insulating housing (10), a pair of outer circuit modules (20*a*) oppositely positioned in the housing, a number of inner circuit modules (20*b*) sandwiched between the outer circuit modules, and a two-piece cover (30) cooperating with the housing for retaining the circuit modules. Each outer circuit module includes a circuit board (22*a*) accommodated in the housing and a number of high-speed cables (201) terminated to the circuit board. Each inner circuit module includes a circuit board (22*b*), a pair of high-speed cables for transmitting differential pairs of signals and a number of low-speed cables (202) arranged between the two high-speed cables for transmitting single-ended signals.

3 Claims, 9 Drawing Sheets

CABLE ASSEMBLY WITH INTERNAL CIRCUIT MODULES

CROSS-REFERENCE TO RELATED APPLICATIONS

Subject matter of this patent application is related to pending U.S. patent application Ser. Nos. 10/316,547, filed on Dec. 10, 2002 and entitled "CABLE ASSEMBLY"; 10/278,520, filed on Oct. 22, 2002 and entitled "ELECTRICAL CABLE CONNECTOR"; unknown but filed on Jun. 19, 2003 and entitled "CABLE ASSEMBLY WITH IMPROVED GROUNDING MEANS"; unknown but filed on Jun. 20, 2003 and entitled "CABLE ASSEMBLY WITH INTERNAL CIRCUIT MODULES"; and unknown but filed on Jul. 1, 2003 and entitled "CABLE ASSEMBLY WITH INTERNAL CIRCUIT MODULES", all of which are invented by Jerry Wu and assigned to the same assignee as this application.

BACKGROUND OF THE INVENTION

1. Field of the Invention

The present invention generally relates to a cable assembly, and particularly to a cable assembly having a plurality of circuit boards for high speed signal transmission.

2. Description of Related Art

With the development of communication and computer technology, high density electrical connectors are desired to construct a plurality of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364 (the '364 patent), issued to Miskin et al., discloses a cable assembly including an insulating housing formed by a pair of substantially identical housing halves and a high-speed electrical cable including a plurality of wires terminated to conductive terminals overmolded in a plurality of thin flat wafers, The housing halves combine to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However the cable and wafer subassembly are retained in the housing by securing the housing halves together through bolts and nuts, thereby complicating the assemblage of the cable assembly. Furthermore, an engagement of the housing halves is easy to become loose due to vibration during the transportation and other matters, whereby the cable and the wafer subassembly cannot be stably retained in the housing. Thus, an electrical connection is adversely affected between the cable assembly and a complementary connector.

U.S. Pat. Nos. 5,924,899 (the '899 patent) and 6,102,747 (the '747 patent), both issued to Paagman, each disclose a cable assembly. Referring to FIGS. 4*a*–4*c* and 5*a*–5*c* of the '899/'747 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules each are retained in the housing through an interference fit with the housing. When the cable assembly is required to disengage from a complementary connector, a pulling force is exerted on an exposed end of the cable for releasing the engagement between the cable assembly and the complementary connector. However, the modules may be pulled back with regard to the housing, thereby adversely affecting an electrical engagement when the cable assembly mates with the complementary connector again. Furthermore, an additional device is employed to bond the cables together, thereby increasing the cost of the production.

A drawback occurred in the '899 patent, the '747 patent and the '364 patent is that when it is desired for both high-speed signals and low-speed signals transmitted in a same cable assembly, the inventions disclosed in all the instant mentioned patents could not be applicable for all the patents are designated for transmitting only high-speed signals.

Hence, an improved cable assembly is highly desired to overcome the disadvantages of the related art.

BRIEF SUMMARY OF THE INVENTION

Accordingly, it is an object of the present invention to provide a cable assembly having strain relief means for substantially resisting a pulling force exerted on a cable thereof.

It is another object of the present invention to provide a cable assembly having a plurality of high-speed cables and a plurality of low-speed cables connecting to circuit boards thereof.

In order to achieve the above-mentioned objects, a cable assembly in accordance with the present invention for engaging a complementary connector comprises an insulating housing, a pair of outer circuit modules positioned in opposite sides of the housing, a plurality of inner circuit modules sandwiched between the outer circuit modules, and a two-piece cover cooperating with the housing for retaining the circuit modules. Each outer circuit module includes a circuit board accommodated in the housing and a plurality of high-speed cables terminated to the circuit board. Each inner circuit module includes a circuit board, a pair of high-speed cables for transmitting differential pairs of signals, and a plurality of low-speed cables extending between and parallel to the two high-speed cables for transmitting single-ended signals. Each circuit module also has a cable clamp bonding the cables.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
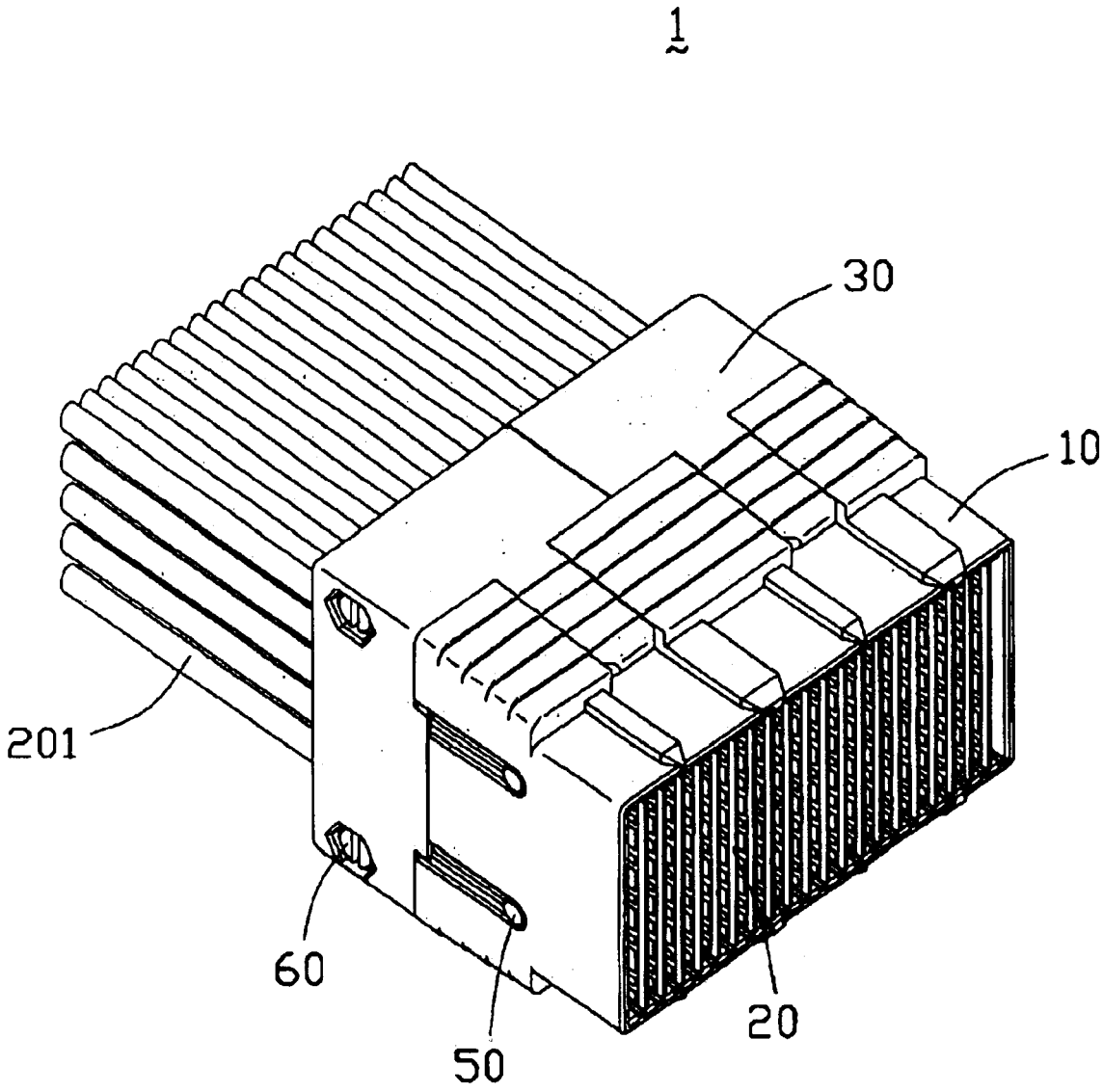
FIG. 1 is a perspective view of a cable assembly in accordance with the present invention.

Reference will now be made to the drawing figures to describe the present invention in detail.

Figure 2:
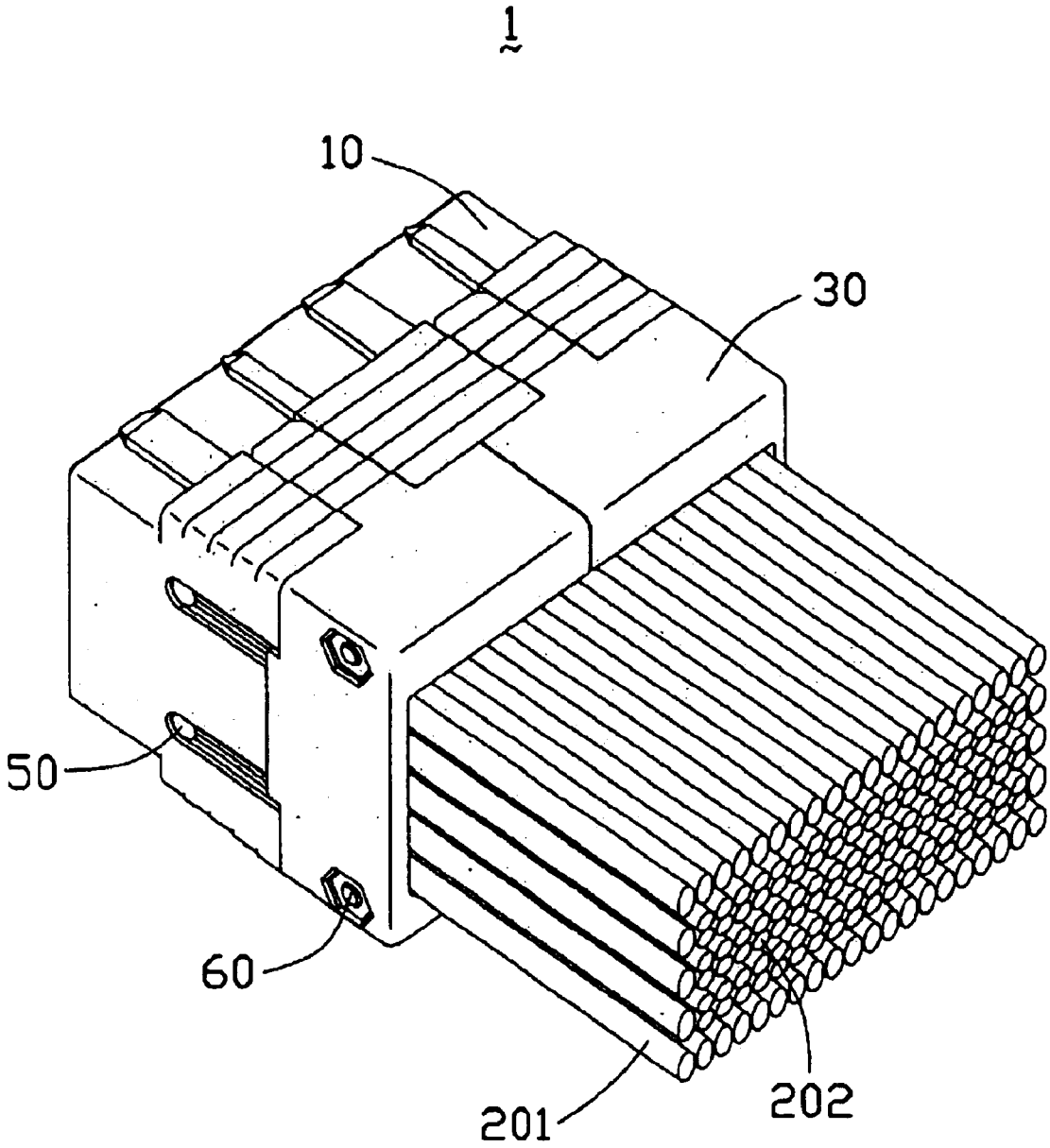
FIG. 2 is another perspective view of FIG. 1.

With reference to FIGS. 1 and 2, a cable assembly 1 in accordance with the present invention comprises a front insulating housing 10, a plurality of circuit modules 20 received in the front insulating housing 10, and a two-piece rear cover 30 together with the front insulating housing 10 for retaining the circuit modules 20.

Figure 3:
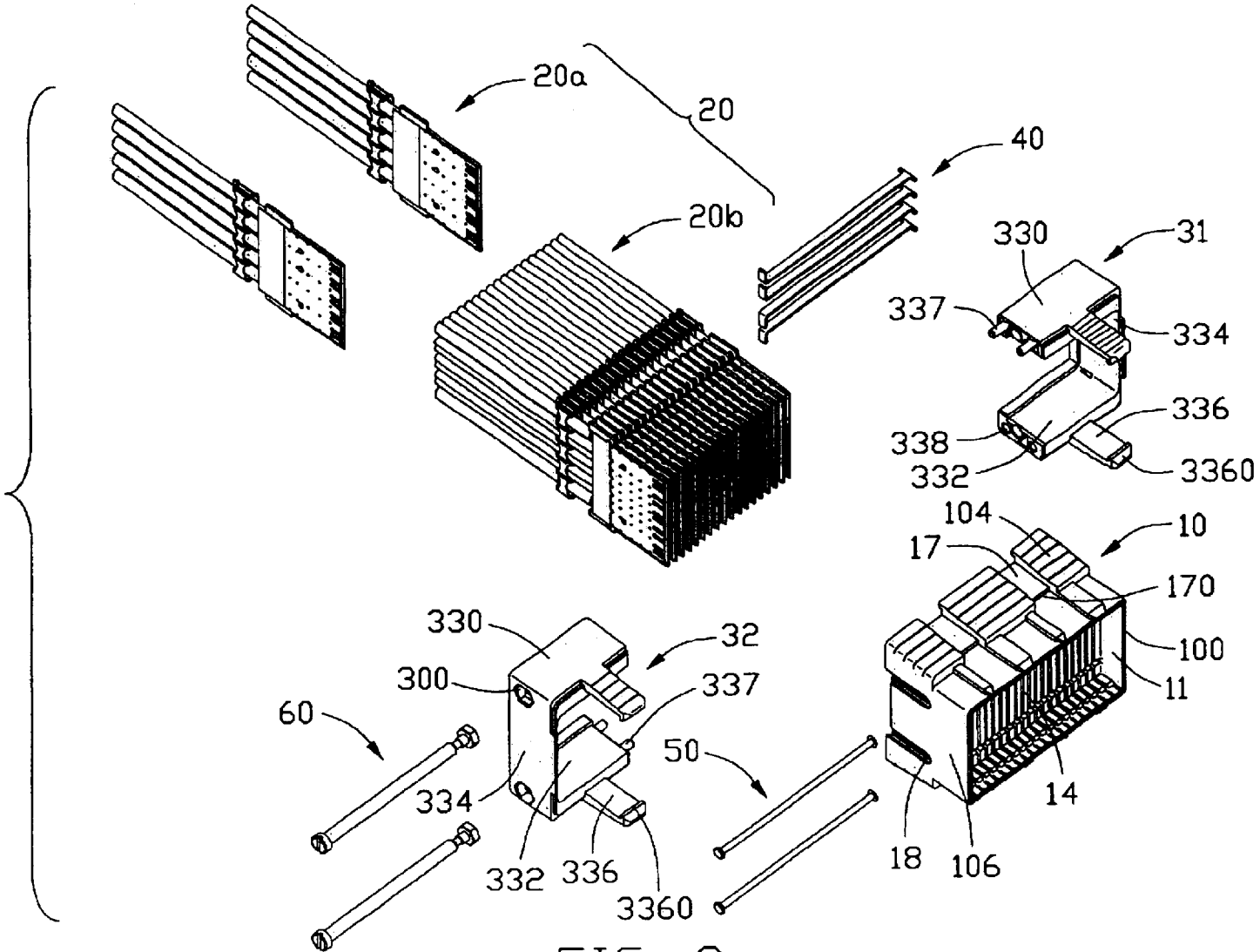
FIG. 3 is an exploded, perspective view of FIG. 1.
Figure 4:
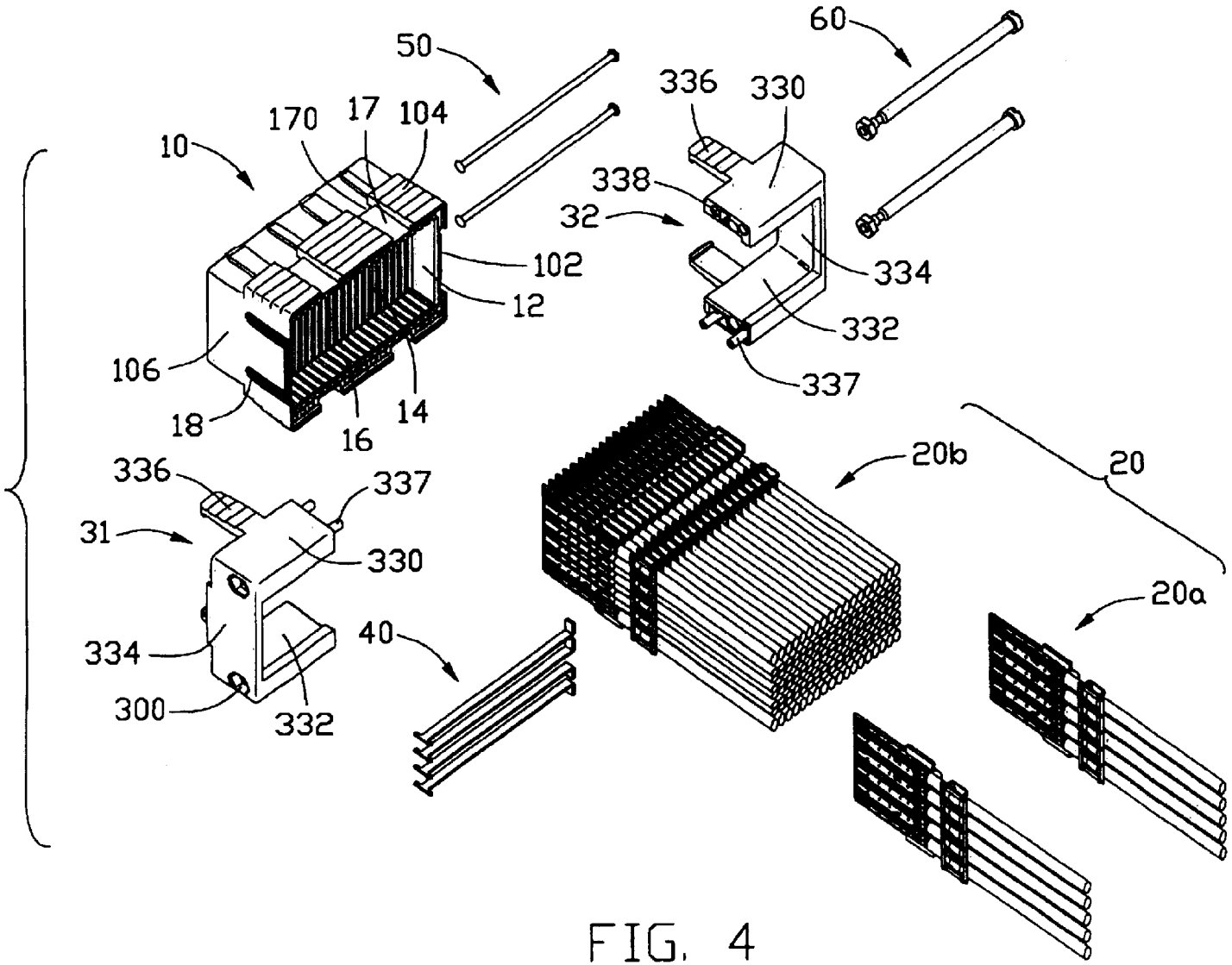
FIG. 4 is an exploded, perspective view of FIG. 2.

Referring to FIGS. 3 and 4, the front housing 10 is generally in a rectangular shape. The housing 10 has a front mating port 11 in a front mating face 100 Which faces a complementary connector (not shown) and a rear chamber 12 in a rear face 102. The housing 10 defines a plurality of parallel channels 14 extending in a front-to-back direction communicating with the front mating port 11 and the rear chamber 12 and a plurality of grooves 16 which are aligned with the channels 14. The housing 10 further defines a plurality of recesses 17 respectively in a top face 104 and a bottom face (not labeled) and a plurality of depressions 170 recessed downwardly from the corresponding recesses 17. An aperture 18 is defined through opposite side faces 106 of the housing 10 in a direction substantially perpendicular to the extending direction of the channels 14.

Continuing to FIGS. 3 and 4, the rear cover 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The rear cover 30 defines a bore 300 extending through the side panels 334 thereof. It should be noted that any other suitable connecting means may be employed to connect the first and second halves 31, 32. This split design helps to facilitate the assembly and installation of the cover 30 onto the housing 10 over the circuit modules 20. Understandably, the first and the second halves 31, 32 can be integrally formed with each other before assembling to the housing 10, if desired.

Figure 5:
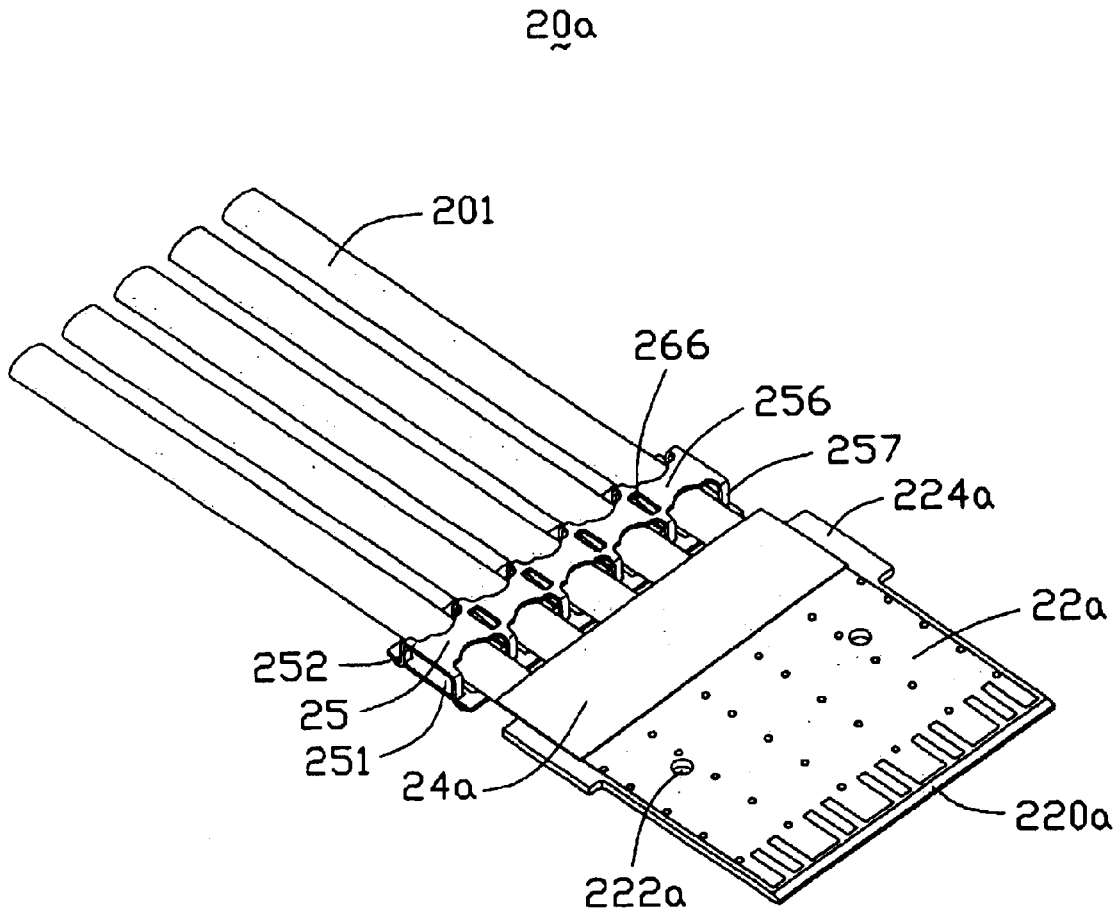
FIG. 5 is a perspective view of an outer circuit module.
Figure 6:
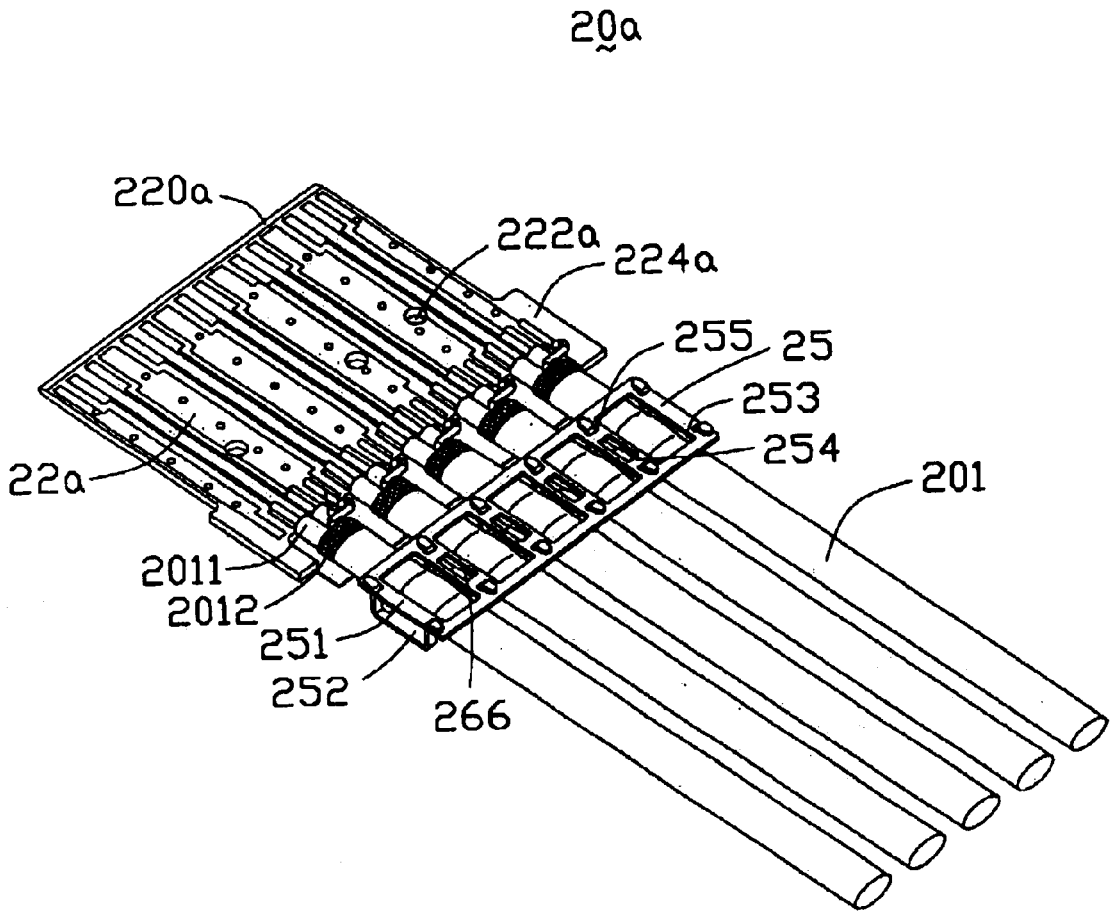
FIG. 6 is another perspective view of FIG. 5.

The circuit modules 20 comprise a pair of outer circuit modules 20*a* and a plurality of inner circuit modules 20*b* arranged between the two outer circuit modules 20*a*. One of the outer circuit modules 20*a* is shown in FIGS. 5 and 6. Each outer circuit module 20*a* comprises a circuit board 22*a* and a plurality of high-speed cables 201 electrically and mechanically connecting with the circuit board 22*a*. The circuit board 22*a* includes a dielectric substrate made of conventional circuit board substrate material, a plurality of conductive signal traces (not labeled) on one side of the substrate for providing electrical paths through the cable assembly 1 and a plurality of grounding traces (not labeled) on both sides of the substrate for grounding purpose. Each circuit board 22*a* comprises a front edge portion 220*a* provided for engaging with the complementary mating connector and a rear edge portion 224*a* to which the high-speed cables 201 are mechanically attached. A through hole 222*a* is provided on the circuit board 22*a* which aligns with the aperture 18 of the housing 10.

The high-speed cables 201 of the outer circuit module 20*a* are arranged in a common plane. In the preferred embodiment, each high-speed cable 201 comprises a pair of wires 2011 for transmitting differential pairs of signals and a grounding wire 2012 soldered to the grounding trace of the circuit board 22*a*.

With reference to FIGS. 5–6, the outer circuit module 20*a* also comprises a first grounding plate 24*a* and a cable clamp 25 adapted for bonding the high-speed cables 201. The first grounding plate 24*a* is configured in a substantially planar shape and is attached to one side of the outer circuit module 20*a* opposite to the high-speed cables 23*a* attached on the other side, The cable clamp 25 includes a first section 251 and a second section 252 both are stamped and formed from metal tapes. The first section 251 defines a plurality of rooms. 253 and forms a plurality of bridges 254 between adjacent rooms 253. Each bridge 254 defines a pair of openings 255 at opposite ends thereof. The second section 252 includes a body portion 256 and two rows of tails 257 upwardly extending from two opposite sides of the body portion 256. The first and second sections 251, 252 clamp ends of the high-speed cables 201 from opposite sides with the tails 257 of the second section 252 being locked in corresponding openings 255 of the first section 251. The ends of the high-speed cables 201 are depressed by the body portion 256 of the second section 252 such that they are partially pressed into corresponding rooms 253 of the first section 251. The first and second sections 251, 252 further define a plurality of through holes 266.

Figure 7:
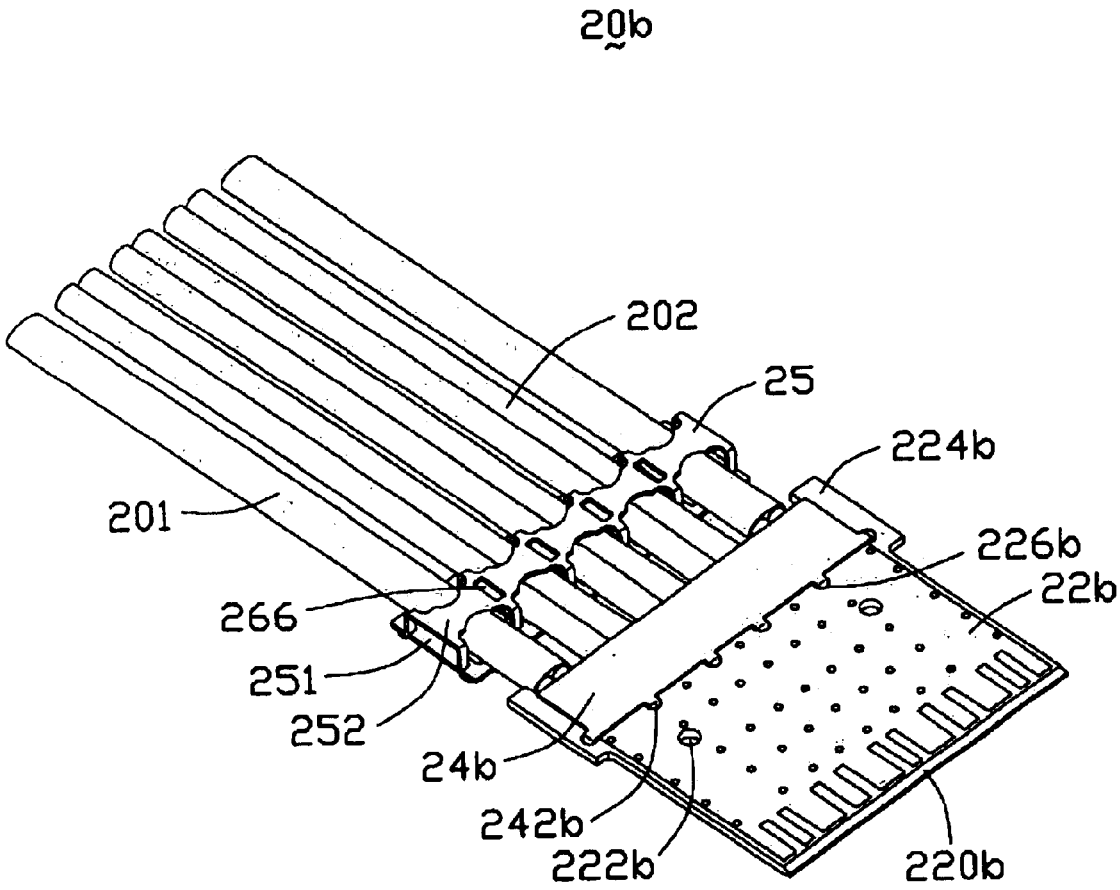
FIG. 7 is a perspective view of an outer circuit module.
Figure 8:
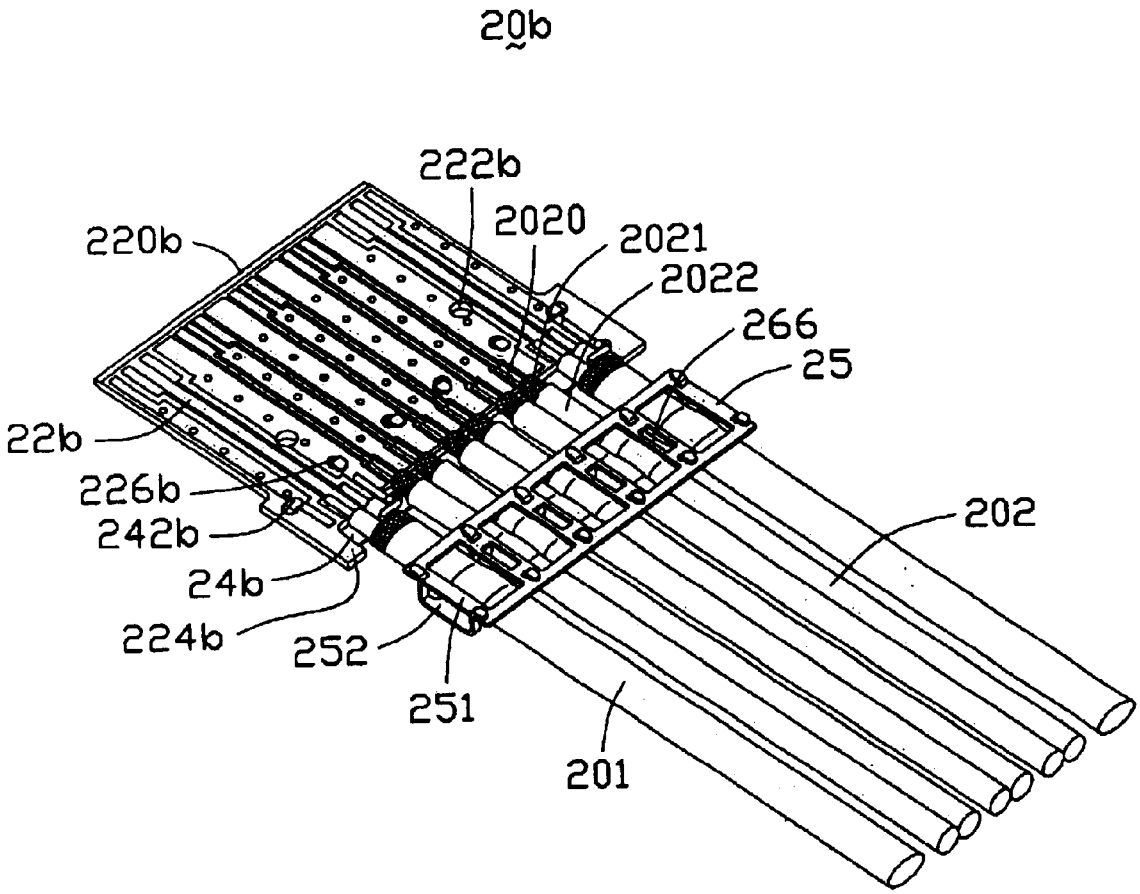
FIG. 8 is another perspective view of FIG. 7.

Similarly, an exemplary one of the inner circuit module 20*b* is shown in FIGS. 7 and 8. Each inner circuit module 20*b* comprises.a circuit board 22*b*, a pair of high-speed cables 201 connecting with the circuit board 22*b*, and a plurality of low-speed cables 202 connecting with the circuit board 22*b* and being arranged between the two high-speed cables 201. The circuit board 22*b* includes a dielectric substrate, a plurality of conductive signal traces (not labeled) on one side of the substrate for providing electrical paths through the cable assembly 1 and a plurality of grounding traces (not labeled) on both sides of the substrate for grounding purpose. Obviously, the arrangement of the traces printed on the circuit board 22*b* of the inner circuit module 20*b* is different from that on the circuit board 22*a* of the outer circuit module 20*a*. Each circuit board 22*b* comprises a front edge portion 220*b* provided for engaging with the complementary mating connector and a rear edge portion 224*b* to which the high-speed cables 201 and the low-speed cables 202 are mechanically connected. A through hole 222*b* is provided on the circuit board 22*b* which aligns with the aperture 18 of the housing 10 and the through hole 222*a* of the first circuit module 20*a*.

In the preferred embodiment, the plurality of low-speed cables 202 are arranged in pairs and each low-speed cable 202 is a coaxial wire for transmitting single-ended signals. Each single-ended coaxial cable 202 comprises a conductive core 2020 surrounded by a dielectric shield (not labeled), a metal braid 2021 enclosing the dielectric shield, and a jacket 2022 at the outmost side of the coaxial cable 202. At a distal end of each single-ended coaxial cable 202, a length of dielectric shield is stripped to expose a corresponding length of conductive core 2020. The bare conductive core 2020 is soldered to the signal trace on the circuit board 22*b* from one side thereof.

The inner circuit module 20*b* also comprises a second grounding plate 24*b* and a cable clamp 25 adapted for being applied to the cables 201, 202. The second grounding plate 24*b* is preferably a copper tape and is formed with a plurality of tabs 242*b* positioned at a periphery thereof. The second grounding plate 24*b* is attached to the circuit board 22*b* from a side opposite to the conductive cores 2020 of the low-speed cables 202 with the tabs 242*b* being retained in corresponding cavities 226*b* defined in the circuit board 22*b* to thereby secure the second grounding plate 24*b* thereon.

The end of each coaxial cable 202 is stripped to further expose a length of braid 2021, the exposed braid 2021 being soldered to the second grounding plate 24*b* for grounding purpose. The cable clamp 25 of the inner circuit module 20*b* is substantially same to that of the outer circuit module 20*a* and will not be described here in detail.

In assembly, the circuit modules 20 are inserted into the channels 14 of the housing 10 from the rear face 102 with the circuit boards 22*a*, 22*b* being substantially retained in the grooves 16. First fastening-elements 40 are inserted into the through-holes 266 of the cable clamps 25 for locking the circuit modules 20 together for strain relief purpose. A second fastening element 50 is inserted into holes 222*a*, 222*b* defined in the circuit boards 22*a*, 22*b* through the aperture 18 of the housing 10. The second fastening element 50 is further fastened to the housing 10 for keeping the circuit modules 20 in their original positions rather than be pushed back when the cable assembly 1 mates with the complementary connector, thereby stably retaining the circuit modules 20 in the housing 10.

The first and second halves 31, 32 of the cover 30 are assembled to the housing 10 with the projections 3360 of the latches 336 mechanically engage the depressions 170 of the recesses 17. At the same time, the first and second halves 31, 32 are connected by an interference engagement between the dowel pins 337 and the corresponding recesses 338. A third fastening element 60 is inserted into the bore 300 of the cover 30 for retaining the circuit modules 20 in the cover 30.

It is noted that since the circuit modules 20 are stably retained by the front housing 10 and the rear cover 30 via the second and third fastening elements 50, 60, a reliable electrical engagement is ensured between the cable assembly 1 and the complementary connector. It is also noted that the cables 201, 202 are clamped by the cable clamps 25, and more importantly, the cable clamps 25 are locked together via the first fastening element 40, whereby a pulling force exerted on the cables 201, 202 can be substantially released.

Figure 9:
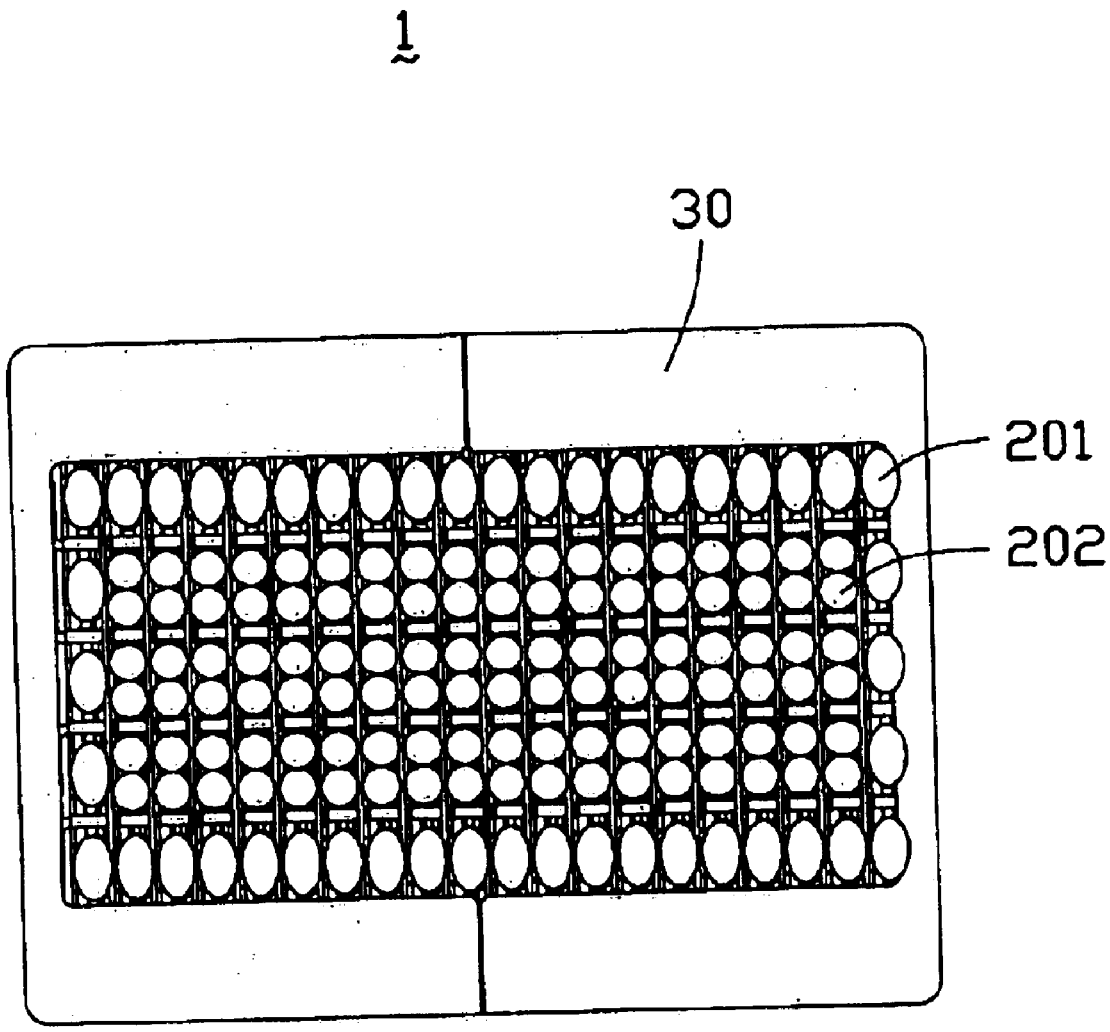
FIG. 9 is a rear plan view of the cable assembly.

Particularly referring to FIG. 9, a rear plan view of the cable assembly is shown. The outer circuit modules 20*a* and the inner circuit modules 20*b* are ranged in such manner that the low-speed cables 202 are substantially surrounded by the high-speed cables 201. Both high-speed signals and low-speed signals can be transmitted in a same cable assembly as required by the user.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly comprising:

an insulating housing defining a plurality of channels;

a plurality of circuit boards juxtaposed in corresponding channels of the housing; and a plurality of high-speed cables and a plurality of low-speed cables terminated to corresponding circuit boards and arranged in such a manner that the plurality of low-speed cables are surrounded by the plurality of high-speed cables; wherein the high-speed cables are used for transmitting differential pairs of signals and the low-speed cables are used for transmitting single-ended signals; wherein each high-speed cable comprises a pair of wires and a grounding wire; wherein the low-speed cables are arranged in pairs, each low-speed cable comprising an insulated, conductive core, a metal braid outside the insulated, conductive core, and a protective jacket enclosing the metal braid; wherein at least two of the circuit boards terminate with only high-speed cables; wherein at least one of the circuit boards terminates with both high-speed cables and low-speed cables; wherein a cable clamp binds the cables terminated to a common circuit board together; wherein the cable clamp comprises a first and a second stamped metallic sections clamping opposite sides of the cables; wherein the first section defines a plurality of rooms and the second section depresses the cables into the rooms, further comprising a first fastening element and wherein each cable clamp defines a through hole for insertion of the first fastening element, further comprising a second fastening element and wherein each circuit board defines a first through hole and the housing defines a pair of second through holes aligned with the first through holes for insertion of the second fastening element, further comprising a cover having first and second halves jointed together and being attached to the housing, the cover defining a bore extending through the first and the second halves.

2. The cable assembly as described in claim 1, further comprising a third fastening element inserting through the bore of the cover.

3. A cable assembly comprising:

an insulating housing defining a plurality of channels;

a plurality of outer circuit modules oppositely arranged in the housing, each outer circuit module comprising a circuit board received in a corresponding channel of the housing, a plurality of high-speed cables terminated to the circuit board, and a grounding plate attached to one side of the circuit board opposite to the high-speed cables; and a plurality of inner circuit modules sandwiched by the outer circuit modules, each inner circuit module comprising a circuit board received in a corresponding channel of the housing, at least two high-speed cables electrically connecting to the circuit board, a plurality of low-speed cables arranged between the at least two high-speed cables and terminated to the circuit board, and a grounding plate attached to one side of the circuit board opposite to the at least two high-speed cables and the low-speed cables;

wherein the high-speed cables are used for transmitting differential pairs of signals and the low-speed cables are used for transmitting single-ended signals; wherein each high-speed cables comprises a pair of wires and a grounding wire wherein the low-speed cables are arranged in pairs, each low-speed cable comprising an insulated, conductive core, a metal braid outside the insulated, conductive core, and a protective jacket outside the metal braid; wherein each circuit module further comprises a cable clamp bonding the cables together, further comprising a cover cooperating with the housing.

* * * * *